US007389546B2

(12) United States Patent
Kameya

(10) Patent No.: US 7,389,546 B2
(45) Date of Patent: Jun. 24, 2008

(54) APPARATUS FOR PUTTING A LOADING OBJECT IN MOUTH BY MOTION OF JAW

(75) Inventor: Sunnsuke Kameya, Sapporo (JP)

(73) Assignee: Shunsuke Kameya (JP)

( * ) Notice: Subject to any disclaimer, the term of this patent is extended or adjusted under 35 U.S.C. 154(b) by 617 days.

(21) Appl. No.: 10/956,992

(22) Filed: Oct. 4, 2004

(65) Prior Publication Data

US 2005/0086725 A1 Apr. 28, 2005

(30) Foreign Application Priority Data

Sep. 24, 1983 (JP) ..... S58-176747
Oct. 2, 2003 (JP) ..... 2003-379138

(51) Int. Cl.
*A42B 1/24* (2006.01)

(52) U.S. Cl. ..... 2/209.13

(58) Field of Classification Search ..... 2/6.2, 2/425, 209.13, 209.14
See application file for complete search history.

(56) References Cited

U.S. PATENT DOCUMENTS

| | | | | |
|---|---|---|---|---|
| 2,654,973 | A * | 10/1953 | Lemelson | 446/27 |
| 5,504,943 | A * | 4/1996 | Han | 2/209.13 |
| 5,581,806 | A * | 12/1996 | Capdepuy et al. | 2/6.2 |
| 7,091,875 | B2 * | 8/2006 | Ondracek | 340/825.19 |
| 7,159,248 | B1 * | 1/2007 | Saintlot | 2/206 |
| 2006/0048286 | A1 * | 3/2006 | Donato | 2/422 |
| 2006/0071781 | A1 * | 4/2006 | Ondracek | 340/539.12 |

* cited by examiner

*Primary Examiner*—Danny Worrell
(74) *Attorney, Agent, or Firm*—Jerome D. Jackson

(57) ABSTRACT

A loading object putting apparatus (a, b, c, d, and e) puts a loading object (e) in mouth by movement of jaw. The loading object putting apparatus (a, b, c, d, e) includes a headgear (a), an arm connecting means (b), an arm (c), a lever apparatus (d) rocked by a jaw, and the loading object (e).

20 Claims, 3 Drawing Sheets

APPARATUS FOR PUTTING A LOADING OBJECT IN MOUTH BY MOTION OF JAW

FEDERALLY SPONSORED RESEARCH

Not Applicable

SEQUENCE LISTING OR PROGRAM

Not Applicable

BACKGROUND OF THE INVENTION

1. Field of Invention

This invention relates to an apparatus for putting a Loading object in a wearer's mouth by movement of the wearer's lower jaw without using hands.

2. Prior Art

In order to make it easy to use, the whistle has been used by hanging on the head via strap.

However, there are the following problems with this general way.

(a) Finding the whistle is hard, so it takes some time to blow the whistle.

(b) The whistle cannot be used if the user's hands are not free.

U.S. Pat. No. 5,504,943 describes a headgear having an attachable whistle.

This conventional technology is able to blow the whistle quickly, but that the technology has a problems of actual use.

(a) The whistle can not be adjusted if a hand is not free.

(b) Without electric power, loud sound can't be made.

In general art, putting a in the mouth has been used for operation of electric equipments by persons having hand trouble.

There are the problems by this general way as following.

(a) It is hard for the persons to put stick in mouth.

(b) It is hard for the persons to put the stick in mouth.

(c) When the persons interrupt the work for a second or talking, the stick must be removed from mouth.

3. Objects

Therefore, an object of this invention is to provide an apparatus for solving the following problems.

(a) To provide an apparatus for putting an object in the wearer's mouth quickly when needed without using the wearer's hand, and removing the object from the wearer's mouth automatically when not needed.

(b) To provide an apparatus capable of use without power.

(c) To provide an apparatus which does not become interruption of other work.

(d) To provide an apparatus which can also use as an option operation of easy electronic equipment using electricity.

SUMMARY

This invention relates to an apparatus for putting a loading object in a wearer's mouth by movement of the wearer's jaw comprising a headgear, an arm having a means for adjusting the arm length and a means for bending the arm and a means for connecting one end of the arm to the headgear side wall and a lever apparatus connecting to the other end of the arm, the lever apparatus having a fulcrum member and a link member connecting the fulcrum and a jaw receptacle holder on the one end of the link member, and a loading object adjustment device on the other end of the link member, a loading object being connected on the loading object adjustment device, whereby the loading object adjustment device adjusts the status of the loading object relating to the wearer's mouth, and characterized by having a means for swingably connecting the lever apparatus to the other end of the arm by movement of the wearer's jaw in contact with the jaw receptacle holder.

DRAWINGS

Figures

DETAILED DESCRIPTION

Figure 1:
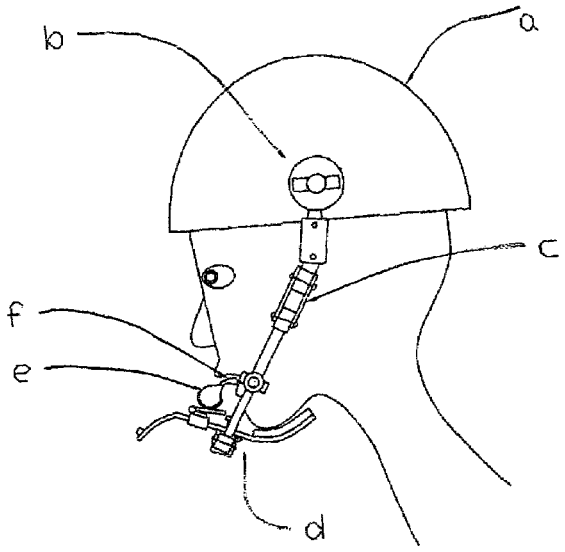
FIG. 1 is a side view of a user wearing the apparatus.

In accordance with the present invention, a loading object putting apparatus (a, b, c, d, e) puts a loading object in the wearer's mouth by movement of the wearer's jaw. FIG. 1 is a side view of the loading object putting apparatus (a, b, c, d, e) being used by user. In this FIG. 1, a wearer supplies the loading object (e) to the wearer's a mouth by the lever apparatus (d) swung by motion of the wearer's jaw.

Figure 2:
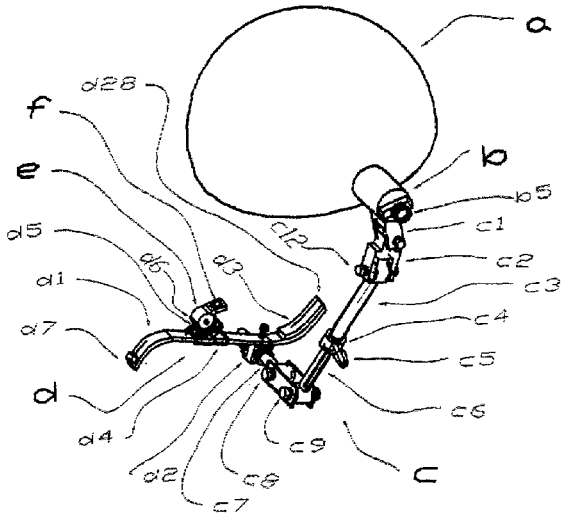
FIG. 2 is an overall perspective view of the apparatus.

FIG. 2 is a perspective view of the loading object putting apparatus (a, b, c, d, e). The putting apparatus has a hard hat (a, b, c, d, e) (a), an arm connection means (b), an arm (c), lever apparatus (d), the loading object (e), and a primary detecting element (1).

Figure 3:
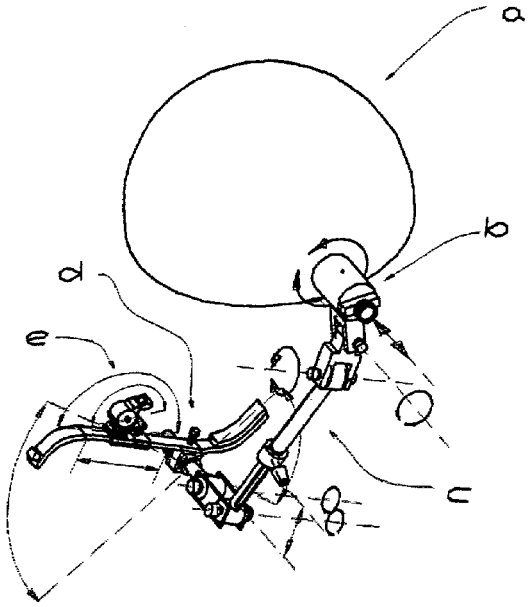
FIG. 3 is an overall perspective view using arrow to show moving direction of the apparatuses moving parts.

FIG. 3 shows the motion of the moving part of FIG. 2 by the arrow. The arm connecting means (b) is attached on the side wall of the hard hat (a). The arm connecting means (b) contains the knob (b5). The knob (b5) moves in the direction of the arrow shown in FIG. 3, and makes the arm (c) a detachable attachment easily.

The arm (c) has attached the lever apparatus (d) at the tip. The arm (c) contains a means for bending the arm and means for adjusting the arm length, in order to adjust the position of the lever apparatus (d). The means for bending the arm has a first joint (c1 and c2) and a second joint (c8, c9).

The means for adjusting the arm length has a slide outer rod (c3), a ring (c4), a slide lock screw (c5), and a slide rod (c6). The slide rod (c6) carries out slide movement in the up-and-down direction. The slide outer rod (c3) stores the slide rod (c6). The slide lock screw (CS) fixes the slide rod (c6). The slide rod (c6) has the slot the way of a straight side into which the slide lock screw (c5) fits was trenched. Thereby, the slide rod (c6) does not rotate. The ring (c4) is attached at the slide outer rod (c3). The ring (c4) has a screw hole. Therefore, the slide lock screw (c5) fits in.

The lever apparatus (d) contains a fulcrum member (d2), a link member (d1), a jaw receptacle holder (d3), jaw receptacle holder putt (d28), a loading object adjustment means (d4.d5), a loading object bolder (d6), weight (d7), and the loading object (e) and a primary detecting element (f). The fulcrum member (d2) is connected to the arm tip stick (d7) possible [a swing]. The link member (d1) is made from the long member. The link member (d1) is connected on the fulcrum member (d2). The link member (d1) has the jaw receptacle holder (d3) in the loading object adjustment means (d4.d5) and the other end at the tip. The loading object adjustment means (d4.d5) has a means for reciprocating means (d4) and a means for adjusting an angle of the loading object (d5). The means for reciprocating means (d4) carries out slide reciprocating movement to the way of a straight side of the link member (d1). The means for adjusting an angle of the loading object (d5) is an apparatus for rocking and adjusting the angle to the mouth of the loading object (e). The means for adjusting an angle of the loading object (d5) is connected on the means for reciprocating means (d4). On the means for adjusting an angle of the loading object (d5), the loading object holder (d6) is connected. Since the loading object holder (d6) is made from the elastic material, it can pinch the loading object (e). Therefore, it is a detachable attachment about the loading object (e) easily. The angle of the loading object (e) can also be adjusted. The primary detecting element (f) is attached on the portion which touches the mouth of the user of the loading object (e). There is a jaw receptacle holder (d3) which touches a jaw in the other end of the link member (d1). The jaw receptacle holder (d3) has made from a part of the end of the link member (d1) curved upward. The jaw receptacle holder (d3) has the jaw putt (d29) made from a soft material in the portion which touches jaw. If a jaw moves, the jaw receptacle holder (d3) will move, the link member (d1) will move to the next, and then the loading object (e) will move, and the loading object (e) will be carried by the mouth. If a user opens a mouth, the loading object (e) will return to the original position. This translation is in weight (d7). The attachment position (d8) of the weight (d7) is made from a part of the other end of the rink member (d1) curved downward. If FIG. 1 is seen, it will be easy to understand this translation. It is for using little weight efficiently.

Figure 4:
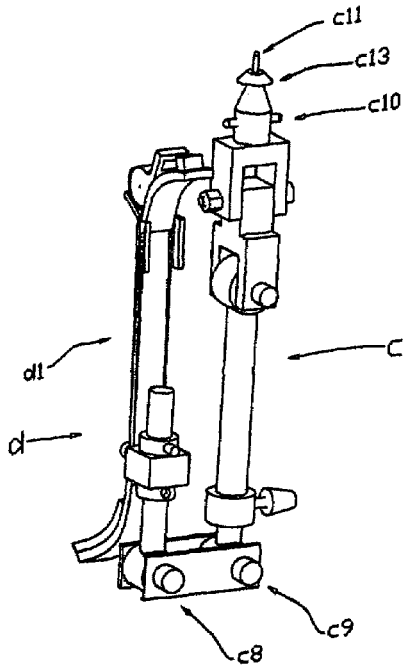
FIG. 4 is a perspective view of a folded up arm and lever apparatus after separating from the arm connecting means on the side of the headgear.

FIG. 4 is a figure of the arm (c) folded up, after removed from the arm attaching means (b). The method of folding up bends the 2nd joint, and is rotating the link member (d1) about 90 degrees on the fulcrum member (d2). The apparatus made to rotate the link member (d1) is a means for rotating the link member, and the apparatus which locks up the link member (d1) is a means for locking the link member.

Figure 5:
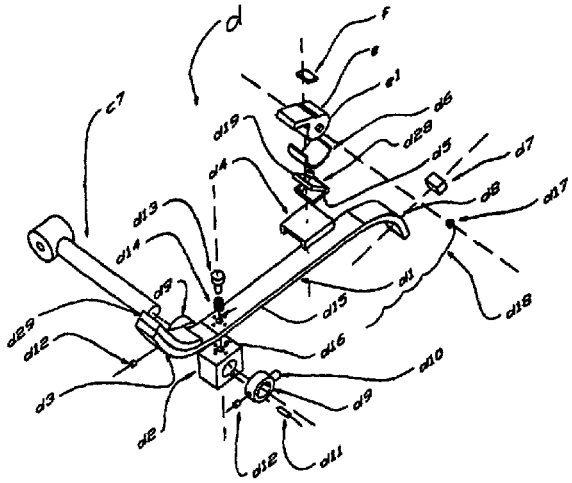
FIG. 5 is a partial detailed perspective view of the lever parts and the end of the arm shown in FIG. 2.

FIG. 5 is a detailed enlarged view of the lever apparatus (d). The means for adjusting an angle of the loading object (d5) has a rocking member (d19), an angle adjusting fulcrum (d30), and an angle adjustment key (d19). The angle adjusting fulcrum (d30) is connected on the means for reciprocating means (d4). The rocking member (d19) is connected with the angle adjusting fulcrum (d30) possible [a swing].

The loading object holder (d6) is connected to the rocking member (d19). Therefore, the loading object (e) is rocked together with the rocking member (d19). The swing means of the lever part (d) has the arm tip stick (c7), the fulcrum member (d2), and two fulcrum member stop rings (d9).

The arm tip stick (c7) is inserted in the insertion opening provided in the fulcrum member side. Therefore, the fulcrum member (d2) is rotatable connected with the arm tip stick (c7). The two fulcrum member stop rings (d9) lock up on both sides of the fulcrum member (d2) on the arm tip stick (c7). The fulcrum member stop ring (d9) is being fixed to the arm tip stick (c7) by the ring fixed screw (d12).

Figure 6:
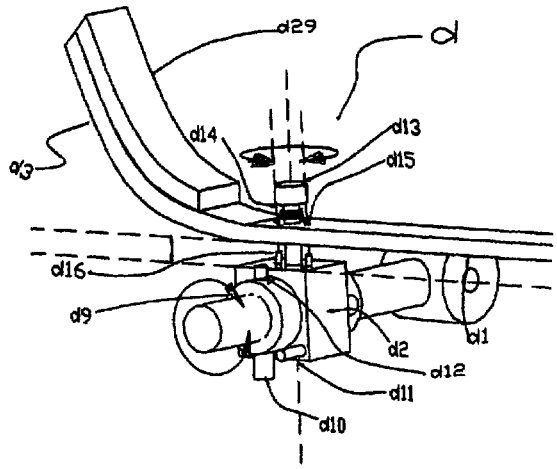
FIG. 6 is a partial detailed perspective view of near the fulcrum member of the lever.

FIG. 6 is an enlarged detail view near the fulcrum member (d2). The one fulcrum member stop rings (d9) have a lever part maintenance pin (d10) within the two fulcrum member stop rings 1 (d9). The lever part maintenance pin (d10) collides with the lever maintenance pin 2 (d11) attached in the side wall of the fulcrum member (d2). Thereby, the angle of the lever apparatus (d) is held. If the ring fixed screw (d12) is loosened, the angle of the lever apparatus (d) can be adjusted. The means for rotating the link member has a link member axis of rotation (d13). The link member axis of rotation (d13) rotatably connects the link member (d1) on the fulcrum member (d2). The means for locking the link member has two link members lock pins (d16), four link member lock holes (d15), and springs (d14). The two link member lock pins (d16) are attached on the fulcrum member (d2). The two link member lock pins (d16) are arranged focusing on the link member axis of rotation (d13) at the diagonal. The four link member lock holes (d15) are attached in the link member (d1) undersurface. The four link member lock holes (d15)—the link member axis of rotation (d13)—an angle equal as a center—arrangement—now, it is. The link member lock pin (d16) and the link member lock hole (d15) fit in mutually. The spring (d14) is attached between the link member axis of rotation (d13) and the link member (d1). The spring (d14) pushes the link member (d1) from a top. Therefore, if the link member (d1) is raised, it can rotate. When a hand lifted the link member (d1), the fink member (d1) is pushed on the spring (d14), and is locked.

Figure 7:
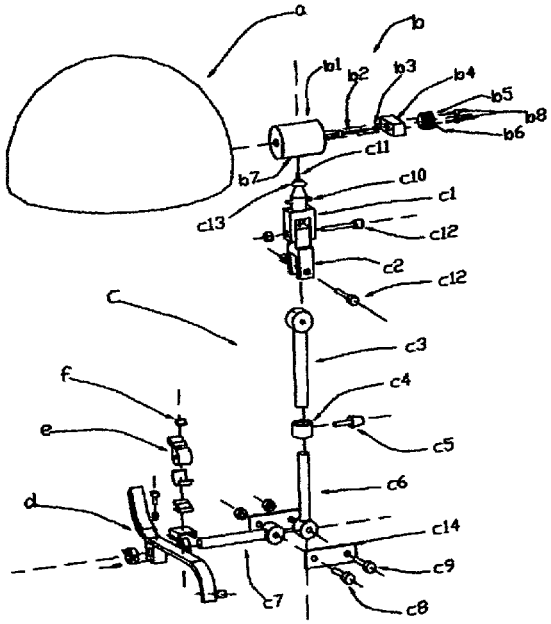
FIG. 7 is the exploded perspective view of the putting apparatus.

FIG. 7 is the whole putting apparatus (a, b, c, d, e) exploded view.

Figure 8:
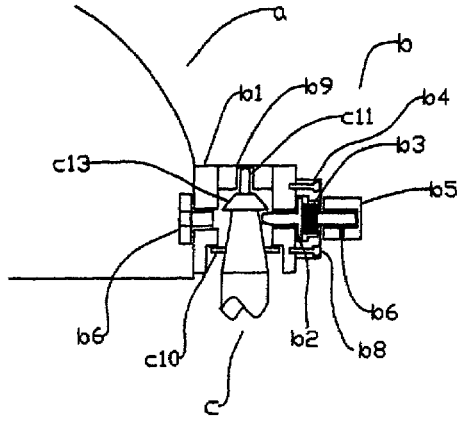
FIG. 8 is a longitudinal sectional view of the arm connecting means.

FIG. 8 is a longitudinal sectional view of the arm connecting means (b). The arm connecting means (b) has a projection (b1), a projection connection bolt (b8), a lid case (b4), a lid case bolt (b8), a knob (b5), a movable pin (b2), a spring (b3), a knob adjustable screw (b6), the arm projection (c13), and a shake prevention pin (c10). The projection (b1) is connected to the hard hat (a) side wall by the projection connection bolt (b8). If the projection connection bolt (b8) is loosened, the projection (b1) can be rotated. A projection (c13) and the movable pin (b2) of the arm (c) fit in each other. The movable pin (b2) has connected with the knob (b5). It is letting the spring (b3) pass to the movable pin (b2). And the spring (b3) is settled into the lid case (b4). Therefore, after the movable pin (b2) is pushed on the projection (c13) of the arm and withdraws, it gets into the hollow of a projection (c13) of the arm. The shake prevention pin (c10) gets into the slot formed in the projection (b1). Therefore, the small shake of the arm (c) can be prevented. A connector terminal (c11) fits into a socket (d9). Therefore, the electric signal detected by the primary detecting element material (f) can be told.

Figure 9:
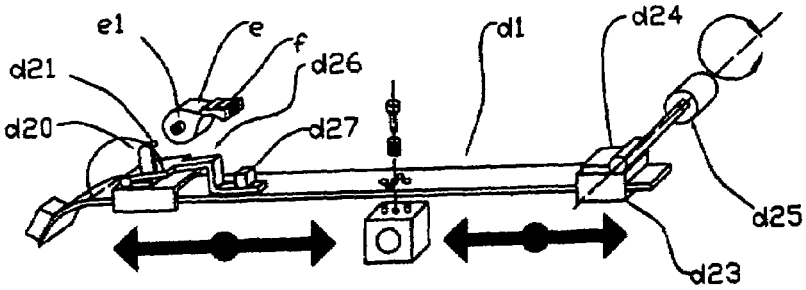
FIG. 9 is a perspective view of the second embodiment of the lever apparatus.

FIG. 9 is other embodiments of the lever apparatus (d). Other embodiments of the lever apparatus (d) have a connector type pin holder (d20), weight (d27), a jaw receptacle holder slide part (d23), a jaw receptacle holder angle adjusting part (d24), and a jaw receptacle holder roller (d25). The connector type pin holder (d20) has a connector terminal (d21) and a connector socket (e1). The connector type pin holder (d20) and the connector socket (e1) are made from the material which conducts electricity. The connector type pin holder (d20) and the connector socket (e1) fit in with each other. Therefore, the electric signal detected by the primary detecting element material (f) can be told. Of course, a detachable attachment and angle adjustment are easily possible. The weight (d27) is attached on the rocking member (d26). Therefore, the rocking member (d26) does not move freely by a shock. The jaw receptacle holder slide part (d23) can move reciprocate to the way of a straight side of the link member (d1). A jaw receptacle holder angle adjusting part (d24) can rock. The jaw receptacle holder roller (d25) rotates, and reduces friction with a jaw.

Figure 10:
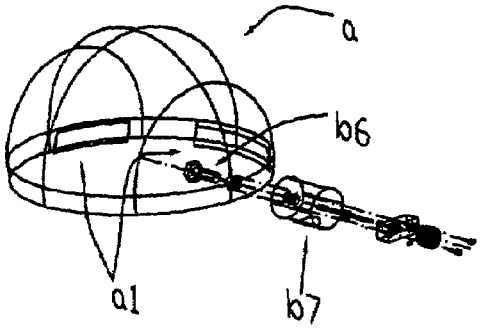
FIG. 10 is the exploded perspective view of the hard hat and the arm connecting means.

FIG. 10 is the exploded perspective view of the hard hat (a) and the arm connecting means (b). The hard hat (a) has balance stable weight (a1). The balance stable weight (a1) is the weight for balancing the whole the putting apparatus (a, b, c, d, e). The balance stable weight (a1) is attached in the direction where the rear inside the hard hat (a) and the putting apparatus (b, c, d, e) are not attached in proper quantity.

Figure 11:
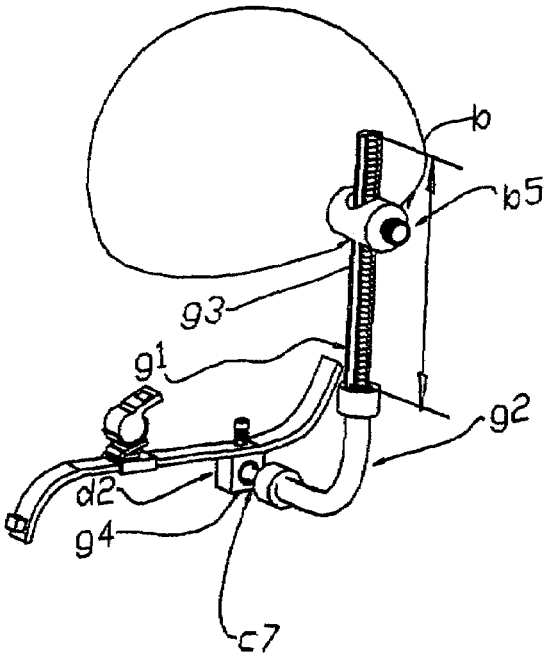
FIG. 11 is a perspective view of the other embodiment of the putting apparatus.

FIG. 11 is other embodiments of the arm connecting means (b). Other embodiments of the arm connecting means (b) have an arm attaching means with an arm slide stick (g1), a flexible stem (g2), a concavity and convexity (g3), a bearing (g4), and the penetrated arm insertion hole. The concavity and convexity (g3) fits in each other with the movable pin (b2). Therefore, if the knob (b5) is pulled, the arm slide stick (g1) can slide up and down.

Figure 12:
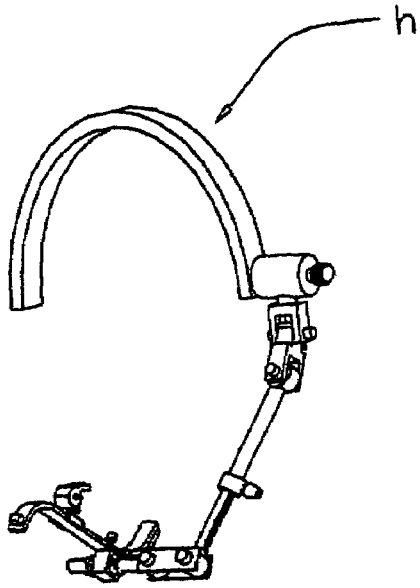
FIG. 12 is a perspective view connecting the putting apparatus to the head band.

FIG. 12 is head band type the putting apparatus. It may be used putting in a head band into a hat. It is good to attach a swing delay apparatus in the lever apparatus (d). Although the structure of this swing delay apparatus is already known art, it shows an example below.

1 The apparatus which a lock cancels when lock operation works in a counter direction and the loading object (e) is added, although it turns to a direction on the other hand.

2 The apparatus which the electromagnet goes out when the detector (f) was attached in the jaw receptacle holder (d3) and the loading object (e), an electromagnet operates, a motion of the lever apparatus (d) is stopped when the jaw separated from the jaw receptacle holder (d3), and a mouth adds the loading object (e), or becomes an opposite pole.

The main uses of this apparatus are shown below.

Traffic guidance member is in the state which added the loading object (whistle) (e) to the mouth brandishes a guidance stick and uses a walkie-talkie by control by the primary detecting element material (f).

When a person with trouble in two hands operates an electric wheelchair and a personal computer, a distribution power board is attached in the putting apparatus (e), and it is operated with a tongue.

It cannot be overemphasized in this invention that various modifications otherwise are possible. Therefore, all the modifications that exist in the true soul of this invention and within the limits are included in a claim.

I claim:

1. An apparatus for putting a loading object in a wearer's mouth by movement of the wearer's jaw, the apparatus comprising:

a headgear, an arm having a means for adjusting the arm length and a means for bending the arm and a means for connecting one end of the arm to the headgear side wall and a lever apparatus connecting to the other end of the arm, the lever apparatus having a fulcrum member and a link member connecting on the fulcrum and a jaw receptacle holder being one end of the link member and a loading object adjustment device being the other end of the link member, a loading object for putting in mouth being connected on the adjustment device, whereby the loading object adjustment device adjusts the status of the loading object in relation to the mouth of the user, and characterized by having a means for swingably connecting the lever apparatus to the other end of the arm by movement of the jaw in contact with the jaw receptacle holder.

2. An apparatus according to claim 1, in which the loading object adjustment device includes a means for reciprocating the loading object in the way of a straight side of the link member.

3. An apparatus according to claim 1, in which the loading object adjustment device includes a means for adjusting an angle of the loading object by a rocking member connecting the loading object to an angle adjusting fulcrum on the reciprocating means.

4. An apparatus according to claim 1, in which the means for swingy movement of the lever apparatus includes an insertion opening on the side of the angle adjusting fulcrum to insertion the other end of the arm.

5. An apparatus according to claim 1, in which the means for adjusting the arm length includes a slide device having a structure to expand and contract the arm.

6. An apparatus according to claim 1, in which the means for bending the arm includes at least one articulation.

7. An apparatus according to claim 1, in which the means for connecting one end of the arm to the headgear side wall includes a recess on the end of the arm, a projection attached to the headgear side wall and an insertion hole provided in the projection and a movable pin in the insertion hole moving in response to the movement of a knob of the projection and a spring pushing the movable pin on the recess.

8. An apparatus according to claim 1, in which the lever apparatus includes a loading object holder made of elastic material on the loading object adjustment device that allows detachable attachment of the loading object to the lever apparatus.

9. An apparatus according to claim 1, in which the lever apparatus includes a means for rotating the link member on the fulcrum and a means for locking the link member.

10. An apparatus according to claim 1, in which the headgear is a hard hat.

11. An apparatus according to claim 1, in which the headgear is a head band.

12. An apparatus according to claim 1, in which the loading object is a whistle.

13. An apparatus according to claim 1, in which the loading object is a detecting element.

14. An apparatus according to claim 1, in which the means for bending the arm is a flexible stem.

15. An apparatus according to claim 1, in which the second means for connecting one end of the arm to the headgear side wall includes at least one continuously formed recesses placed on side of the arm downward from the end of the arm, the projection attached to the headgear side wall having a through—insertion—hole provided in the projection and the movable pin in the insertion hole moving in response to the movement of knob on the projection and the spring pushing the movable pin on the recess.

16. An apparatus according to claim 1, in which the jaw receptacle holder is formed by one end of the link member curved upward.

17. An apparatus according to claim 1, in which the jaw receptacle holder includes a jaw putt made from a soft material.

18. An apparatus according to claim 1, in which the jaw receptacle holder includes a jaw receptacle holder slide device sliding on the link member to adjust the position of the jaw receptacle holder for jaw.

19. An apparatus according to claim 1, in which the jaw receptacle holder includes an angle adjustment for adjusting the angle of the jaw receptacle holder.

20. An apparatus according to claim 1, in which the means for swingy movement of the lever apparatus includes a means for temporarily delaying the swingy movement when the loading object begins to turn down.

* * * * *